US005499525A

United States Patent [19]

Kordak et al.

[11] Patent Number: 5,499,525

[45] Date of Patent: Mar. 19, 1996

[54] HYDRAULIC DRIVE FOR A SHEET METAL FORMING PRESS

[75] Inventors: Rolf Kordak; Michael Reinert, both of Lohr; Thassilo Maxeiner, Gemünden/Main, all of Germany

[73] Assignee: Mannesmann Rexroth GmbH, Germany

[21] Appl. No.: 142,490

[22] PCT Filed: Mar. 25, 1993

[86] PCT No.: PCT/DE93/00275

§ 371 Date: May 20, 1994

§ 102(e) Date: May 20, 1994

[87] PCT Pub. No.: WO93/19866

PCT Pub. Date: Oct. 14, 1993

[30] Foreign Application Priority Data

Mar. 27, 1992 [DE] Germany ..... 42 10 053.4
Jun. 10, 1992 [DE] Germany ..... 42 18 954.3

[51] Int. Cl.[6] ..... B21J 9/18

[52] U.S. Cl. ..... 72/453.03; 72/407; 72/453.13; 100/259; 267/119

[58] Field of Search ..... 72/20, 352, 453.13, 72/407, 453.02, 453.03; 100/259; 267/119

[56] References Cited

U.S. PATENT DOCUMENTS

| | | | |
|---|---|---|---|
| 2,269,778 | 1/1942 | Merrill | 72/453.13 |
| 4,229,965 | 10/1980 | Spacek et al. | 72/453.13 |
| 4,819,429 | 4/1989 | Kordak | 60/414 |
| 4,819,430 | 4/1989 | Becker . | |
| 5,070,695 | 12/1991 | Metzner | 60/448 |

FOREIGN PATENT DOCUMENTS

| | | | |
|---|---|---|---|
| 2449490 | 2/1980 | France . | |
| 1029237 | 4/1958 | Germany . | |
| 2126328 | 3/1973 | Germany . | |
| 3040297 | 6/1982 | Germany . | |
| 3402634 | 3/1985 | Germany . | |
| 3521699 | 4/1986 | Germany . | |
| 4018972 | 12/1991 | Germany . | |
| 317215 | 12/1988 | Japan | 72/453.13 |

OTHER PUBLICATIONS

Rexroth Worldwide Hydraulics, "Using Industrial Hydraulics", 1984, pp. 6/16–6/57.

Struktur eines hydrostatischen Antriebs mit zwei Linear–achsen fur eine Biegemaschine. In: fluid Aug. 1990 S.15.

Dluzik, K., Energiesparende Schaltungskonzepte fur Hydro–Zylinder am Drucknetz, In: O+P Olhydraulik und Pneumatik 33, 1989, Nr.5 S.444.

Dr. Lechner et al, "Schnelle Pumpenverstellung und neuartige Schaltungskonzepte fur verlustarme hochdynamische Regelantriebe", 8. Aachener Fluidtechnisches Kolloquium, Mar. 15/17, 1988, pp. 61–85.

(List continued on next page.)

*Primary Examiner*—David Jones
*Attorney, Agent, or Firm*—Cushman Darby & Cushman

[57] ABSTRACT

The invention relates to a drive for a press, in particular for a sheet metal forming press, the press including a press ram which can be moved up and down and a hydraulic movable counter support. The counter support can be moved in a forward stroke in the direction towards the press ram via at least one hydraulic cylinder by a first hydrostatic machine, and in a return stroke by the press ram. In known presses, during the return stroke of the counter support, the pressure medium is displaced from the hydraulic cylinder while a predetermined pressure is maintained by means of a pressure relief valve (pressure limiting valve) or a throttle valve (flow control valve). The balance sheet of energy of such a drive of such a press is to be improved. This is achieved by providing that the first hydrostatic machine is a pressure controlled machine, preferably an axial piston machine. Preferably, the axial piston machine can be swiveled in both directions, i.e. pivoted towards both sides. Further, at least during a portion of the return stroke of the counter support, pressure medium from the hydraulic cylinder flows across a second hydrostatic machine.

15 Claims, 10 Drawing Sheets

OTHER PUBLICATIONS

Andreas De Wille, "Transformer–Steuerung fur Kleinpressen mit Eilund Arbeitshub, Betrieb mit Luft/Wasser–Emulsion", Leibfried Mascninenbau GmbH, Jan. 1985, pp. 52–53.

Rolf Ziegler et al, "Pumpendirektregelung: ein energiesparendes Antriebskonzept mit hoher Regelgute".

Fgang Backe et al, "eue Moglichkeiten beim lektrohydraulischen Load–Sensing", O+P Othydraulik und Pneumatik, 1990 Nr.2, pp. 106–114.

HYDRAULIC DRIVE FOR A SHEET METAL FORMING PRESS

BACKGROUND OF THE INVENTION

The present invention relates to a hydraulic drive for a press, in particular for a sheet metal forming press, said press comprising a press ram adapted to be moved up and down, and a hydraulically displaceable counter support, said counter support being adapted to be moved in a forward stroke in the direction towards the press ram via a hydraulic cylinder by means of a first hydrostatic machine, and said counter support being adapted to be moved by said press ram in a return or rearward stroke.

For example, DE-AS 20 43 967 discloses a sheet metal forming press having a press ram and a counter support and a hydraulic drive with the features mentioned above. In said known press a pump pumps oil into the hydraulic cylinder during the forward stroke of the counter support. As soon as the counter support has reached its end position, the supply of pressure medium from the pump driven by an electric motor to the cylinder is interrupted by means of control valves. When the counter support is displaced during the return stroke by means of the press ram, a certain pressure has to be maintained in the cylinder. It is generally known that for this purpose the pressure medium is drained into the pressure medium container or tank by means of a relief (or pressure limiting) valve, a flow control (or throttle) valve or a proportional valve. See for instance, EP 0 173 755 B1. When draining the pressure medium via the relief valve or via the flow control valve a large amount of heat is generated which gets lost without being used. Possibly even cooling has to be provided. This means additional cost for structural components.

SUMMARY OF THE INVENTION

It is an object of the present invention to create a hydraulic drive for a press, in particular for a sheet metal forming press, such that the energy balance sheet is improved with respect to prior art drives, i.e. the losses of unused energy are reduced.

This object is achieved for a hydraulic drive for a press, in particular for a sheet metal forming press by providing that the hydrostatic machine is designed as a pressure controlled machine, in particular, as a pressure controlled axial piston machine which is, in particular, adapted to be swivelled in both directions, and that at least during a part of the return stroke of the counter support pressure medium from the hydraulic cylinder flows across a second hydrostatic machine. Due to the pressure control of the first hydrostatic machine it is achieved that said machine supplies only the oil which is necessary to balance the leakage losses when the counter support has moved against an abutment at the end of the forward stroke, and that during the return stroke of the counter support the necessary pressure is maintained in the hydraulic cylinder. At the same time the energy which has been transferred by the press ram to the hydraulic cylinder can be retreaved by the second hydrostatic machine and can be used for driving the press ram or it can be fed into the electric power supply system.

Preferred embodiments of the hydraulic drive for a press are disclosed in the dependent claims.

Naturally, while the pressure medium flows from the hydraulic cylinder across the second hydrostatic machine, said machine is connected with a first port to the hydraulic cylinder. Depending on whether the pressure at the second port of the second machine is higher or lower than the counter support pressure in the hydraulic cylinder, the second machine operates as a hydraulic motor or as a hydraulic pump, wherein in both cases the balance sheet of the energy is improved. When operating as a hydraulic motor, the second machine supplies power. When operating as a hydraulic pump, less energy has to be supplied, inasmuch as the volume of the pressure medium coming from the hydraulic cylinder needs to be elevated to the higher pressure level at the second port of the second machine, i.e. starting already from the counter support pressure.

Preferably, the hydrostatic machine for the counter support is also provided with a flow dependent control (i.e. a control which is dependent on the volume) superceded by the pressure control. This means that during the forward stroke the cylinder is moved with constant speed, a speed which can, however, be adjusted by changing the pivot or swivel angle of the hydrostatic machine.

It is sometimes desirable that the counter support is moved fast during the forward stroke and is moved slowly together with the press ram during the return stroke. Thus, during the forward stroke a large volume of oil has to be supplied per unit of time. So as to avoid having to use a first hydrostatic machine having a very large displacement volume, it is possible to move the counter support during the forward stroke by subjecting the piston of at least a first hydraulic cylinder with pressure. The piston of at least a second hydraulic cylinder is dragged along during the forward stroke by the counter support, wherein the pressure chamber of the second hydraulic cylinder can be filled independently of the supply flow of the first hydrostatic machine with pressure medium. Under these circumstances, the first hydrostatic machine only needs to supply the oil volume for the first hydraulic cylinder or the first hydraulic cylinders. Claims in preferred embodiments, during the return stroke of the counter support pressure medium flows via a second hydrostatic machine, said pressure medium coming from the pressure chamber of the second hydraulic cylinder, or from the first hydraulic cylinder, or from both, the second hydraulic cylinder as well as the first hydraulic cylinder. The pressure chamber of the second hyraulic cylinder is, in accordance with a preferred embodiment, fillable via a first check valve opening towards the pressure chamber and is adapted to be connected via a second valve to a port of the second hydrostatic machine, so as to provide the filling by bypassing the first hydrostatic machine and so as to provide for the emptying via a second hydrostatic machine. The second valve can be, in a particularly simple manner, a check valve which blocks towards the pressure chamber. If one desires to have the possibility to block completely the pressure chamber of the second hydraulic cylinder, so as to lock or immobilize the counter support in a lifted position, then the second valve can also be a reversely installed pilot controlled check valve or a 2/2 directional cartridge valve.

In a preferred embodiment, the first hydrostatic machine having a counter support which is movable in a forward stroke, is at the same time the second hydrostatic machine, with pressure medium from the hydraulic cylinder being drained across said second hydrostatic machine during the return stroke. In this context, it is explicitly stated that here and in other parts of the application the expression "second hydrostatic machine", "third hydrostatic machine" and so on, does not at all mean that indeed two, three and so on, hydrostatic machines are present. The characterization of a hydrostatic machine as first, second third, etc. is simply a short form to characterize a defined technical feature of the hydrostatic machine. In case a hydrostatic machine comprises at the same time a plurality of thusly characterized technical features, then said hydrostatic machine is, at the same time, for instance a first and a second or, for isntance, a second and a third machine.

The energy removed from the hydraulic cylinder during the return stroke can for instance be used to be returned into the electric power supply system, for instance, via an electric motor, in particular a 3-phase motor, which drives the second hydrostatic machine during pump operation. It would appear to be more favourable to use the energy directly for driving the press ram. This way the transfer of the energy into electrical energy can be avoided, a transfer which is subject to heavy losses.

With the hydraulic drive of an embodiment of the invention it is possible to make use of at least a portion of the energy taken from the hydraulic cylinder without using a mechanical coupling or the detour via electric energy.

In a preferred embodiment, the first hydrostatic machine is mechanically coupled with a drive unit for the press ram for a transfer of the torque, so that a transfer of mechanical energy into electrical energy can be avoided even easier.

Because of the better dynamic characteristics of an adjustable hydrostatic machine compared with an electric motor, characteristics which allow a good control and a good closed loop control, and because of the large density of power, the drive unit for the press ram comprises preferably a third adjustable hydrostatic machine. In accordance with an embodiment of the first hydrostatic machine, by means of which the counter support is movable during the forward stroke, is mechanically coupled to the third adjustable hydrostatic machine for transmitting torque.

In case the press ram is moved mechanically, in particular by means of a crank drive, then, preferably in addition to the third hydrostatic machine a fourth hydrostatic machine is provided which is hydraulically coupled with the third hydrostatic machine and which is mechanically coupled with the press ram.

Said fourth hydrostatic machine in the drive line of the press ram maintains its speed particularly precisely if it is secondarily controlled, wherein said drive line of the press ram may also contain a hydraulic accumulator.

Besides presses having a mechanically movable press ram, there are other presses in which the press ram can be moved in a forward and a return (rearward) stroke by means of a hydraulic cylinder having a press piston which separates a press cylinder chamber and a return stroke cylinder chamber. A third hydrostatic machine, which is mechanically coupled to said first hydrostatic machine for the purpose of transmitting torque, is then adapted to be connected with one output, preferably with the press cylinder chamber, wherein from said third hydrostatic machine oil can be supplied from an oil reservoir (tank) to the press cylinder chamber, at least during a pressing operation. Thus, the energy regained during the motor operation of the first or third hydrostatic machine is used for the built-up of a pressure in the press cylinder chamber and the hydraulic cylinder of the counter support, respectively. An electric motor connected with the two hydrostatic machines then needs to have only a low power rating. Possibly, during certain periods of time it is even possible to feed energy into the electric power supply system.

Similar to the advantageous use of the potential energy of the counter support, this likewise appears to be favourable with respect to the press ram, provided that the press ram moves initially downwardly during its forward stroke in a pre-movement solely based on its weight. It is then preferred that the first hydrostatic machine is not only coupled to a third hydrostatic machine, but is also mechanically coupled to a fifth hydrostatic machine with reversible volume flow, said fifth machine preferably being an axial piston machine swivelable or pivotable beyond zero (this means that the machine can be operated as a pump or a motor); further, said fifth hydrostatic machine is adapted to be connected with a first output of the return stroke cylinder chamber, wherein by means of the fifth hydrostatic machine oil can be displaced from the return stroke cylinder chamber during the pre-movement of the press ram.

The hydraulic drive can be designed such that the power supplied by the fifth hydrostatic machine during motor operation is used for the direct drive of the first hydrostatic machine, when said first hydrostic machine lifts the counter support during the pre-movement of the press ram. The second output of the fifth hydrostatic machine can be connected to the oil tank. It is, however, also possible to connect the second output of the fifth hydrostatic machine to the press cylinder chamber, such that the oil displaced from the return stroke cylinder chamber flows into the press cylinder chamber. Then, into the press cylinder chamber only an oil volume has to be replenished which is equal to the differential between the volume of the press cylinder chamber, which is generally larger than the return stroke cylinder chamber, and the volume of the oil displaced from the return stroke cylinder chamber; this replenishment has to occur from other sources, for instance from the third hydrostatic machine. Then, the third hydrostatic machine can be smaller than in another case, where the third hydrostatic machine by itself fills the press cylinder chamber.

In case that the power which can be supplied by the fifth hydrostatic machine during the displacement of oil from the return stroke cylinder chamber can not be used immediately, or in case the use of said power is more favourable at a later point in time, because this will lead to a more equalized power consumption of the electric motor, then it is preferable, in accordance with claim 20, that the second output of the fifth hydrostatic machine is connected to a hydrostatic accumulator. In this connection, a design is preferred according to which the return stroke cylinder chamber can be relieved towards the oil tank by means of a controllable valve which will only be open during the operating phase or movement of the press ram; further, for said design, the hydraulic accumulator can be charged by the fifth hydrostatic machine during the operating phase via the valve beyond the condition reached during the pre-movement of the press ram. Here, the angle of pivotal or swivel movement of the fifth hydrostatic machine is preferably limited to a small value, so that the power consumption is only very small.

In accordance with a particularly preferred embodiment of the hydraulic drive of the invention the second hydrostatic machine is mechanically coupled to the press ram. A first port of said machine is connected to a pressure medium reservoir. Moreover, a second port of said machine, the hydraulic cylinder of the counter support and the pressure side of the first hydrostatic machine are connected to each other, said first hydrostatic machine being of the pressure controlled type and adapted to be driven by a motor. For the hydrostatic drive of the counter support as well as of the press ram now only two hydrostatic machines are used. The hydraulic drive is preferably designed such that no pressure medium is displaced to the pressure medium reservoir via the first hydrostatic machine which is pressure controlled and which may be of a design with a swivel or pivotal movement in both directions, i.e. towards both sides. In fact, in case pressure medium would be displaced, then also the first hydrostatic machine would operate as a motor and return power to the electrical power supply system via the electric motor connected with the first hydrostatic machine. Inasmuch as, however, the change from mechanical energy to electrical energy is connected with high losses, such a return of energy into the electrical power supply system appears to be less favourable than an immediate use or storage of the hydraulic energy.

The first machine, the pressure of which can be controlled, is designed to maintain at the second port of the second hydrostatic machine a quasi stationary pressure. So as to allow, nevertheless, a slow movement of the counter support in accordance with claim 24 the following is provided: between the second port of the second machine and pressure side of the first machine on the one hand side, and the hydraulic cylinder on the other hand side, a preferably adjustable flow valve is provided, which is effective for one direction of movement of the hydraulic cylinder and is ineffective for the other direction of movement of the hydraulic cylinder. This ineffectiveness in the other direction of movement is obtained in a very simple manner by placing a check valve in the bypass to the flow valve, said check valve blocking flow towards the hydraulic cylinder. This has the consequence that during lifting of the counter support between the second port of the second machine and the pressure side of the first machine and the flow valve the pressure adjusted at the first machine exists. Between the flow valve and the hydraulic cylinder exists load pressure. During the return stroke of the counter support the pressure adjusted at the first machine exists at the hydraulic cylinder and in the lines or conduits between said hydraulic cylinder and the pressure side of the first machine and the second port of the second machine.

In case it is desired to move the press ram while the counter support is stationary, for instance during installation or trial runs, then a valve is provided by means of which the flow of pressure medium to the hydraulic cylinder of the counter support can be blocked.

Sometimes it is desirable, that the counter support can be lowered during installation or during a trial run, without the press ram being moved. It is conceiveable that for such a lowering operation the pressure medium is drained via the first hydrostatic machine, and that for that purpose the machine is of a design with swiveling in both directions, i.e. pivotal movement towards both sides and with an output flow dependent control. However, in such an arrangement initially a hydraulic accumulator, which is possibly connected to the pressure side of the machine, will discharge down to the load pressure of the counter support, prior to a movement of said counter support. Possibly, the counter support moves initially uwardly, starting from a position below its upper abutment. If the counter support eventually reaches its lower abutnment, the hydraulic accumulator continues to discharge. Thus, when switching the drive on, it is necessary to initially charge the hydraulic accumulator to the preset or adjusted pressure. Because of said disadvantages, a valve is placed between the hydraulic cylinder of the counter support and a pressure medium reservoir, said valve being adapted to drain pressure medium from the hydraulic cylinder to the pressure medium reservoir, bypassing the first hydrostatic machine.

Also, for the hydraulic drive of certain embodiments, the hydrostatic machine, which is mechanically coupled to the press ram, is preferably of the secondary control type.

A plurality of the embodiments of the invention of the hydraulic drive for a press are shown in the drawing. The invention will now be explained in detail referring to said drawing.

DETAILED DESCRIPTION OF THE PRESENTLY PREFERRED EXEMPLARY EMBODIMENTS

Figure 1:
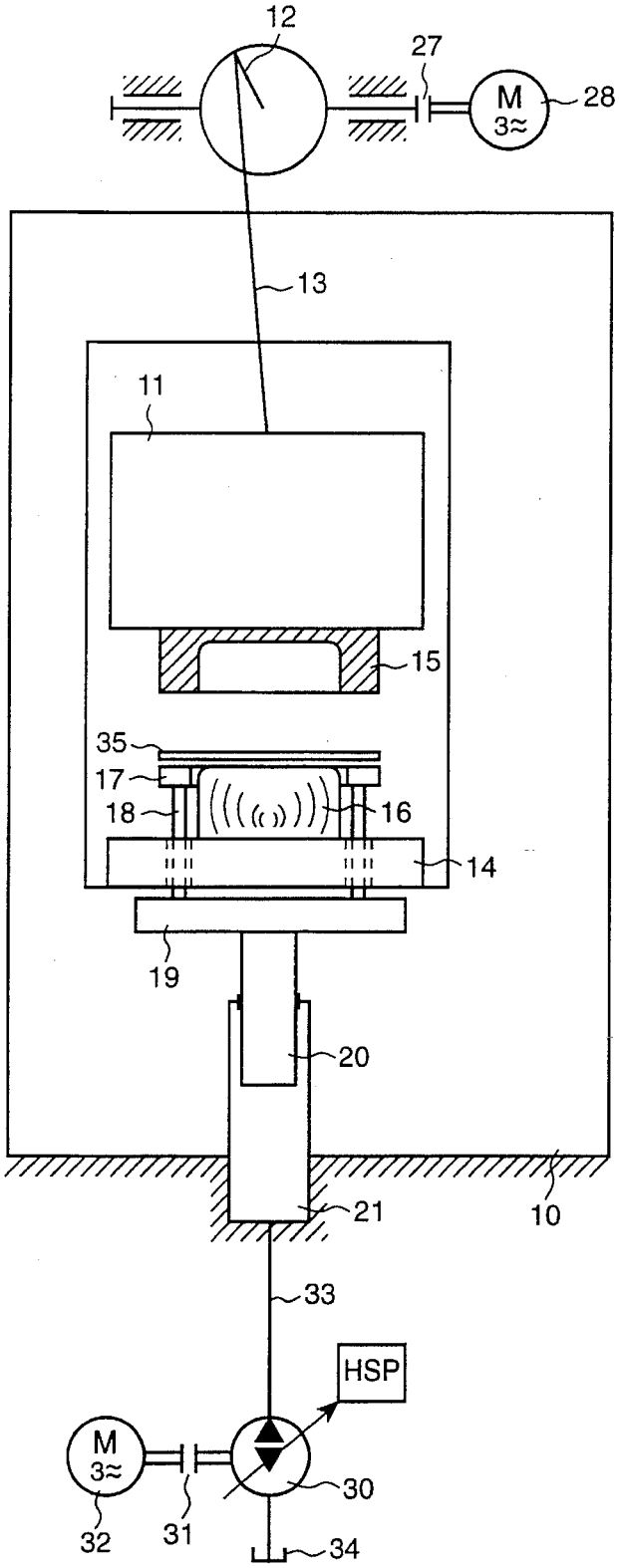
FIG. 1 is a schematic representation of the first embodiment, wherein the press ram is driven by a 3-phase motor with constant or controlled speed, and a hydrostatic machine for moving the counter support is driven by another 3-phase motor.

The press shown in the Figures is suitable to form deep drawn parts from sheet metal but also from sheets of plastic material. For the embodiments shown in FIGS. 1 to 8 and 10 a frame 10 is provided within which a press ram 11 is vertically guided. The press ram is mechanically driven by means of a crank drive which comprises a rotary crank 12 turning in one direction only, and a coupling rod 13. Said coupling rod 13 being articulately connected to said crank 12 with one end, said rod being further articulately connected with the other end to a ram 11; alternatively, the press ram 11 is hydraulically driven.

For the embodiments of FIGS. 1 to 8 and 10 the ram 11 carries at its side facing towards the press table 14 a female tool die 15. The respective male tool die 16 is mounted to the press table 14. The male tool die 16 is surrounded by an annular counter support 17 which is supported by a support plate 19 via individual bolts 18 which extend through said press table 14; said support plate 19 being located below said press table 14. The support plate 19 is supported by the plunger 20 of a plunger cylinder 21. The plunger cylinder 21 is mounted at the frame 10 and is located centrally with respect to the ram 11 such that the plunger 20 and together with it the support plate 19, the bolts 18 and the counter support 17 can carry out movements in vertical direction. For the press of FIG. 9, the press ram 11 is also hydraulically driven. The counter support 17 is formed by a plate which is supported by a plurality of hydraulic cylinders. Further details of the embodiment of FIG. 9 will be discussed later.

In the embodiment of FIG. 1, the crank is coupled by means of a fixed coupling 27 mechanically to a 3-phase motor 28. The 3-phase motor can drive said crank 12 in a predetermined direction of rotation. The speed of the 3-phase motor can be controlled or adjusted due to the fact that the 3-phase motor is supplied with energy via rectifiers. By means of the coupling rod 13 the rotary movement of the crank 12 is transferred into a reciprocal movement of the ram 11. In case crank 12 rotates with a constant speed, then the ram 11 is moved sinus-like.

For the embodiments of FIGS. 1 to 8 a hydrostatic machine 30 is designed as an axial piston machine swiveling in both directions, i.e. providing movement towards both sides and being provided with a pressure control, said hydrostatic machine 30 being mechanically coupled via a fixed coupling 31 to a 3-phase motor 32. Hydrostatic machines with swiveling in both directions, i.e. with pivotal movement towards both sides are generally known. It should only be mentioned here that it is a consequence of this feature that for such a machine the volume flow in such a machine and the effective direction of the torque can be reversed while the direction of rotation is maintained.

The axial piston machine 30 is connected on the one side via a line or conduit 33 to the cylinder 21 and on the other side to a tank (oil collecting reservoir) 34. The machine 30 is provided with a control dependent on the amount of fluid, however, with a pressure control superimposed thereto.

For lifting the plunger 20, the axial piston machine 30 is operated as a pump. The speed with which the plunger 20 is moved is predetermined by the control based on the amount of fluid (flow dependent control). As soon as the support plate 19 abuts against an abutment (not shown in detail) at the frame 10, the pressure in the cylinder 21 increases up to a value predetermined by the pressure control. The axial piston machine 30 now only supplies the oil lost due to leakage. In the Figures the support plate 19 is shown in the position in which it is in abutment at said abutment of said frame. It can be recognized that the counter support 17 is aligned or flush with the upper surface of the male tool die 16 facing towards the press ram 11 and extends under a sheet metal 35 placed on the male tool die 16. The press ram 11 moves in the pre-movement of the prestroke, based on its weight, downwardly and eventually clamps, based on the pressure existing in the cylinder 21, the sheet metal between the female tool die 15 and the counter support 17. For the further movement of the press ram 11 downwardly during the operation of the prestroke, the counter support 17 is taken along against the pressure existing in the cylinder 21, whereby the sheet metal remains clamped between the female tool die 15 and the counter support 17 and is drawn over the male tool die 16. The pressure medium is displaced from the cylinder 21 via the axial piston machine 30 into a tank 34. Hereby the axial piston machine operates as a motor. Thus, in the embodiment of FIG. 1, the first hydrostatic machine is also the second hydrostatic machine. Moreover, said machine drives in the embodiment of FIG. 1 also the 3-phase motor 32. Thus, energy is fed back into the electric power supply system.

Figure 2:
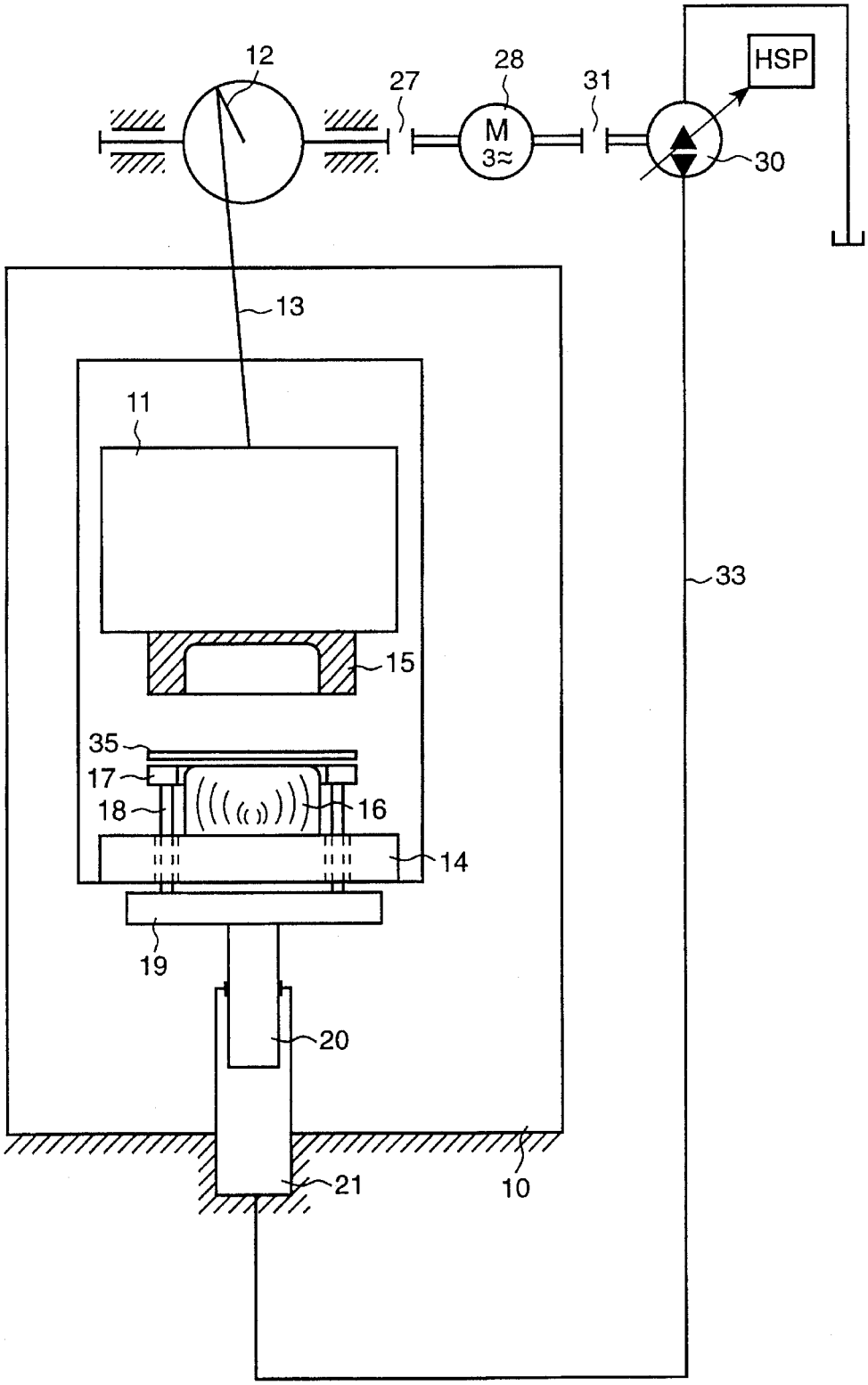
FIG. 2 shows schematically a second embodiment wherein a controllable 3-phase motor drives the press ram as well as the hydrostatic machine.

The embodiment of FIG. 2 differs from the embodiment of FIG. 1 only insofar as the axial piston machine 30, which is connected via a conduit 33 to the cylinder 21, is driven by the 3-phase motor 28 via a fixed coupling 31, i.e. the motor 28 which also drives the crank 12. Here, the power supplied by the axial piston machine 30 during the return stroke of the counter support 17 is directly used for the movement of the press ram without a change of energy.

Figure 3:
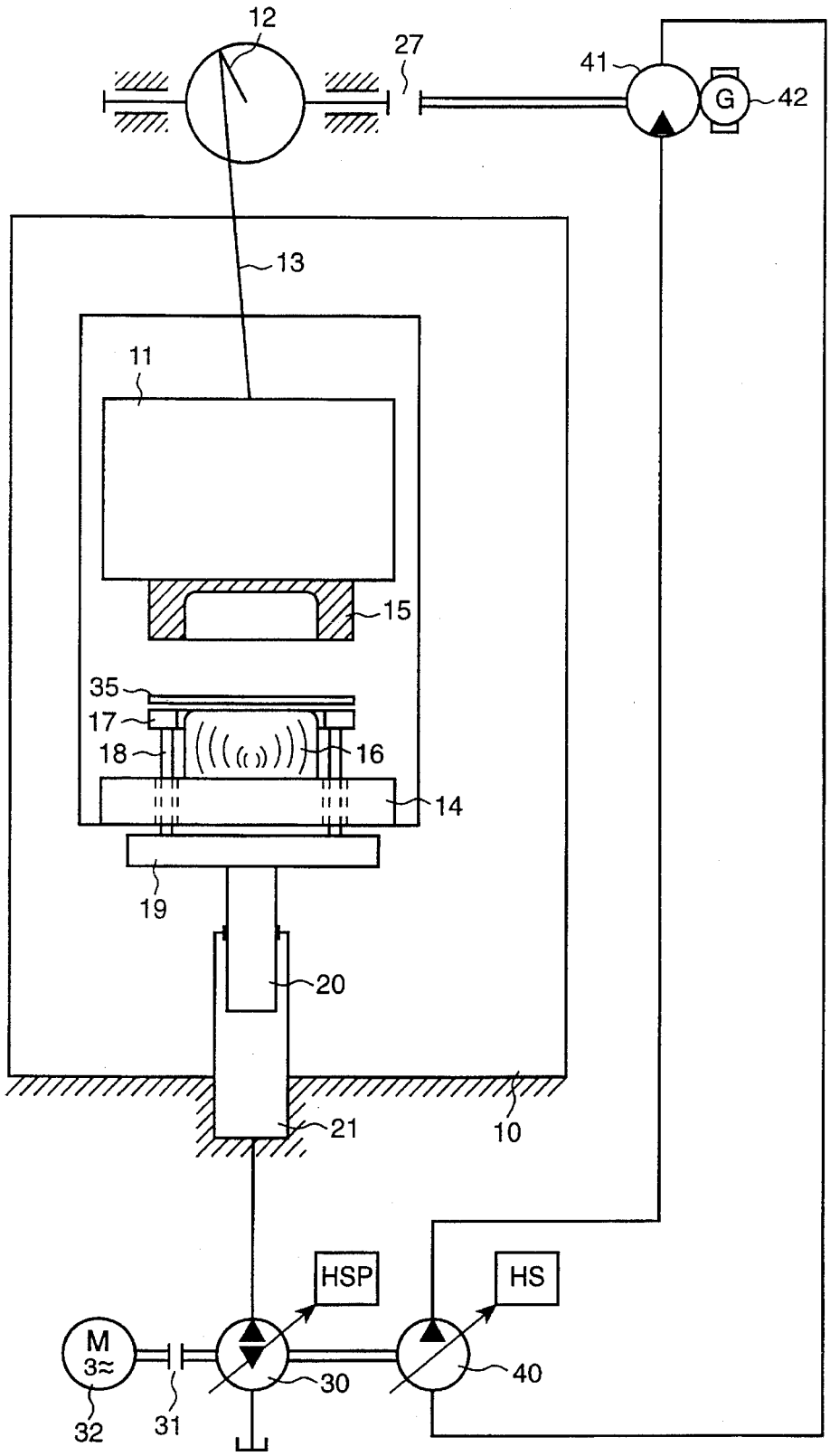
FIG. 3 is a schematic representation of a third embodiment wherein the press ram is driven by a speed controlled hydraulic motor and a 3-phase motor is mechanically coupled to the hydrostatic machine for moving the counter support, said 3-phase motor being also connected to a hydraulic pump for driving said hydraulic motor.

The embodiment of FIG. 3 corresponds to the embodiment of FIG. 1 insofar as the axial piston machine 30 is mechanically coupled to a 3-phase motor 32 for driving the plunger 20, and it is the first and second hydrostatic machine. Together with the axial piston machine 30 the 3-phase motor 32 drives a hydraulic pump 40 (third hydrostatic machine) which is hydraulically connected in a closed hydraulic circuit with a hydraulic motor 41 (fourth hydrostatic machine). Without having shown this in detail, the leakage of the hydraulic pump 40 and of the hydraulic motor 41 is replaced in a manner known per se by an axiliary pump which supplies, from a small reservoir, continuously a sufficient volume of liquid via a check valve to the low pressure side of the closed circuit. The hydraulic motor 41 drives via a fixed coupling 27 the crank 12. The speed of the hydraulic motor 41 is supposed to be largely constant, but should be adjustable. For that reason, the hydraulic motor is connected with a tacho-generator 42 which taps or senses the speed of the hydraulic motor 41. Depending on the sensed speed the hydraulic pump 40 is controlled such that the delivered flow of liquid leads to a largely constant speed of the hydraulic motor 41.

Figure 4:
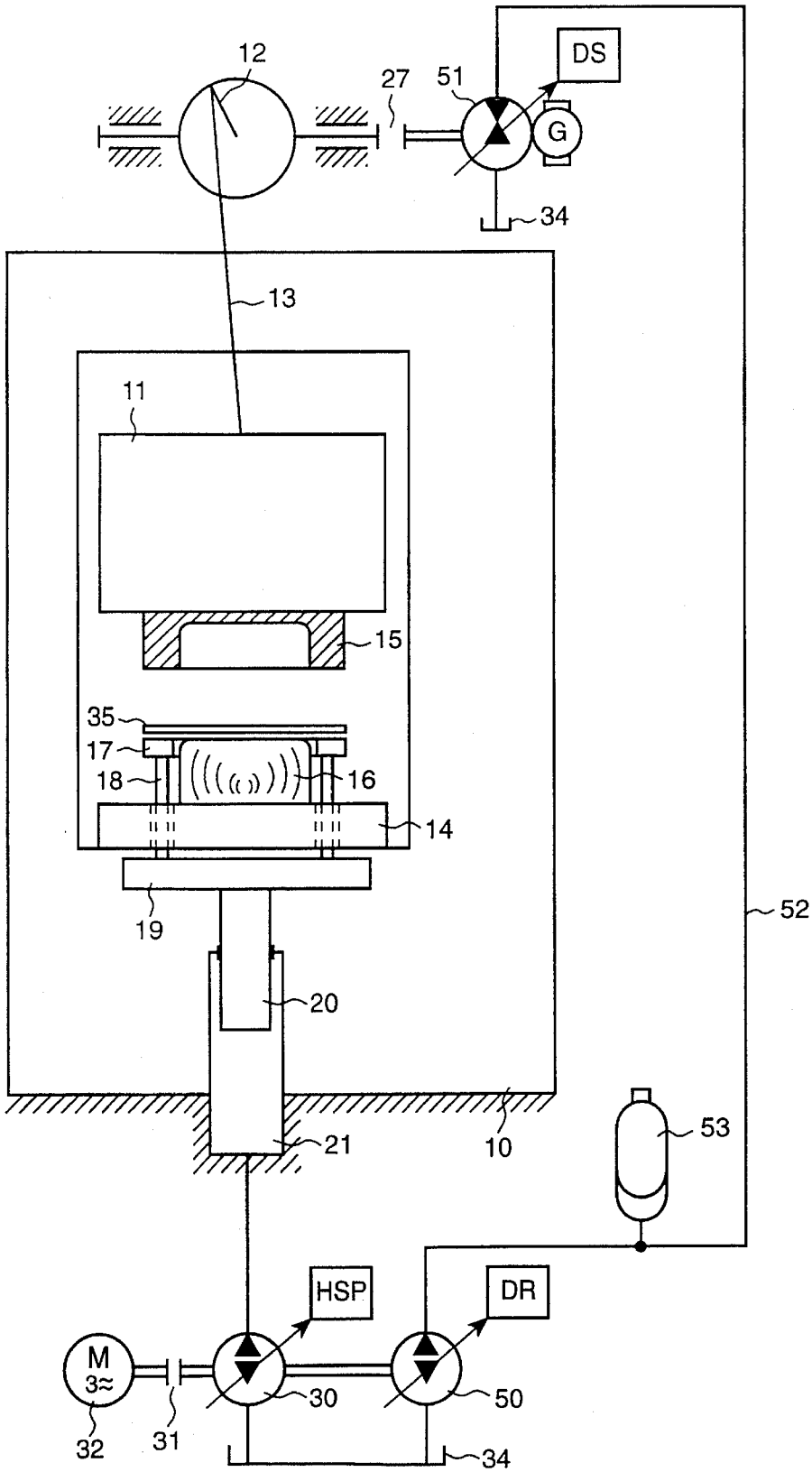
FIG. 4 is a schematic representation of a fourth embodiment similar to that of FIG. 3, wherein, however, the hydrostatic machine for driving the press ram is of the secondary control type.

For the embodiment of FIG. 4 the hydraulic machine 30 is again driven by a 3-phase motor 32 via a coupling 31, and machine 30 is the first and second hydrostatic machine. The hydraulic pump 40 is replaced by a hydrostatic machine 50 (third hydrostatic machine) and the hydraulic motor 41 is replaced by a hydrostatic machine 51 (fourth hydrostatic machine). Both hydrostatic machines 50 and 51 are preferably axial piston machines. Said machines are connected to each other via a line or conduit 52 and are each connected to the tank 34. A hydraulic accumulator 53 is connected to the conduit 52. By means of the pressure controlled axial piston machine 50 and the hydraulic accumulator 53 a largely constant pressure is maintained in conduit 52, said pressure being independent of the torque derived from the axial piston machine 51 for constant speed. The circuit containing the axial piston machines 50 and 51 and the accumulator 53 is a so-called secondary controlled circuit within which the speed of the secondary unit 51 is sensed or tapped by means of the tacho-generator 42 and is maintained at a largely constant but adjustable or controllable value. The swivel or pivot angle of the secondary unit 51 is adjusted or controlled according to the amount of the existing torque, said control being carried out by means of a closed loop control.

As already mentioned, in the embodiment of FIG. 1, energy is returned into the electric power supply system during motor operation of the axial piston machine 30. In the embodiment of FIG. 2 during motor operation of the axial piston machine 30, the 3-phase motor 28 is directly assisted by the axial piston machine 30 when rotating the crank, and thus the amount of power taken from the electric power supply system is reduced. In contrast to the embodiment of FIG. 1, the mechanic-hydraulic energy of the axial piston machine 30 does not have to be changed into electrical energy for being used. In the embodiment of FIG. 3, the axial piston machine 30 is used during motor operation for driving the pump 40, so that the transfer of the mechanic-hydraulic energy into electric energy is avoided. The embodiment of FIG. 4 corresponds in so far to the embodiment of FIG. 3; however, in the embodiment of FIG. 4 the speed of the axial piston machine 51 is more precisely maintained due to the secondary controlled circuit as is true for the speed of the axial piston motor 41 in the embodiment of FIG. 3. This would appear to be particularly advantageous due to the influence of the axial piston machine 30 onto the axial piston pump 50 in the drive line of the press ram 11. Moreover, in a situation of extreme load distribution, the overflow energy coming from the counter support can be stored via the axial piston machine 30 in the hydraulic accumulator. Moreover, the axial piston machine 30, as well as the axial piston machine 50 can supply power via the 3-phase motor 32 into the electric power supply system.

Different from the embodiments of FIGS. 1 through 4, for the presses shown in FIGS. 5 through 8, the press ram 11 is vertically guided and fixedly mounted at the piston rod 60 of a piston 61, forming part of a differential cylinder 62; said piston 61 can be hydraulically moved up and down. The piston 61 divides the interior of the differential cylinder 62 into two pressure chambers 63 and 64. One of said pressure chambers, the pressure chamber 63 on the piston rod side, is referred to as a return stroke cylinder chamber 63 and the other pressure chamber 64 which is located above the piston 61 is referred to as the press cylinder chamber 64. Connected with both chambers 63 and 64 is a pressure sensor 65 and 66, respectively, for supplying an electrical output signal corresponding to the pressure.

For the movement of the piston 61 in the differential cylinder 62 an axial piston pump 70 (third hydrostatic machine) is provided. One output 71 of said axial piston pump 70 is connected via a line or conduit 72 to the press cylinder chamber 64 and the other output 73 of the pump 70 is connected for the embodiments of FIGS. 5, 7 and 8 to the tank 34 and for the embodiment of FIG. 6 via conduit 74 to the hydraulic cylinder 21. The supply flow through the axial piston pump 70 is reversible while maintaining the direction of rotation. A pressure control is superimposed onto the control of the supply flow. The axial piston pump 70 is mechanically coupled to the electric motor 32 with which also the axial piston pump 30 is connected. Specifically, pumps 30 and 70 have the same drive shaft.

The hydraulic drives of FIGS. 5 through 8 comprise another axial piston machine 80 (fifth hydrostatic machine) which is connected with an output 81 via a conduit 82 to the return stroke cylinder chamber 63. For the embodiments of FIGS. 5 through 7 the other output 83 of the machine 80 is connected to the tank 34 and for the embodiment of FIG. 8 the other output is connected via conduit 72 to the press cylinder chamber 64. The supply flow through the axial piston machine 80 is reversible with the direction of rotation being maintained. A pressure control is superimposed to the supply flow dependent control. Moreover, for the axial piston machine of FIG. 8 the pressure port and the suction port can be exchanged with each other.

Figure 5:
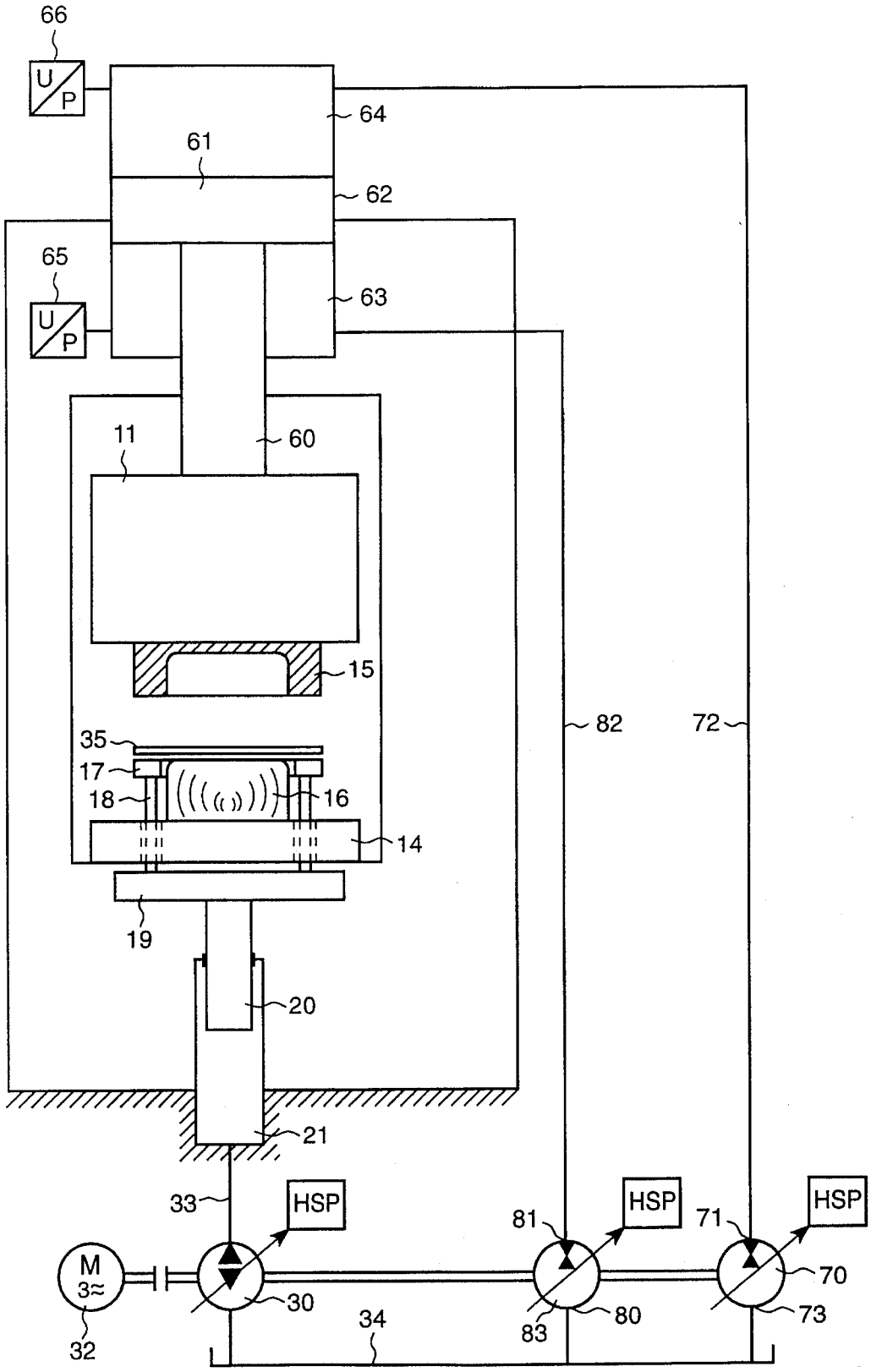
FIG. 5 discloses schematically a fifth embodiment, according to which the press ram is hydraulically driven by a hydraulic cylinder, and wherein with the first hydrostatic machine a third and a fifth hydrostatic machine are mechanically coupled, wherein the second output of the fifth hydrostatic machine is connected to an oil reservoir.
Figure 6:
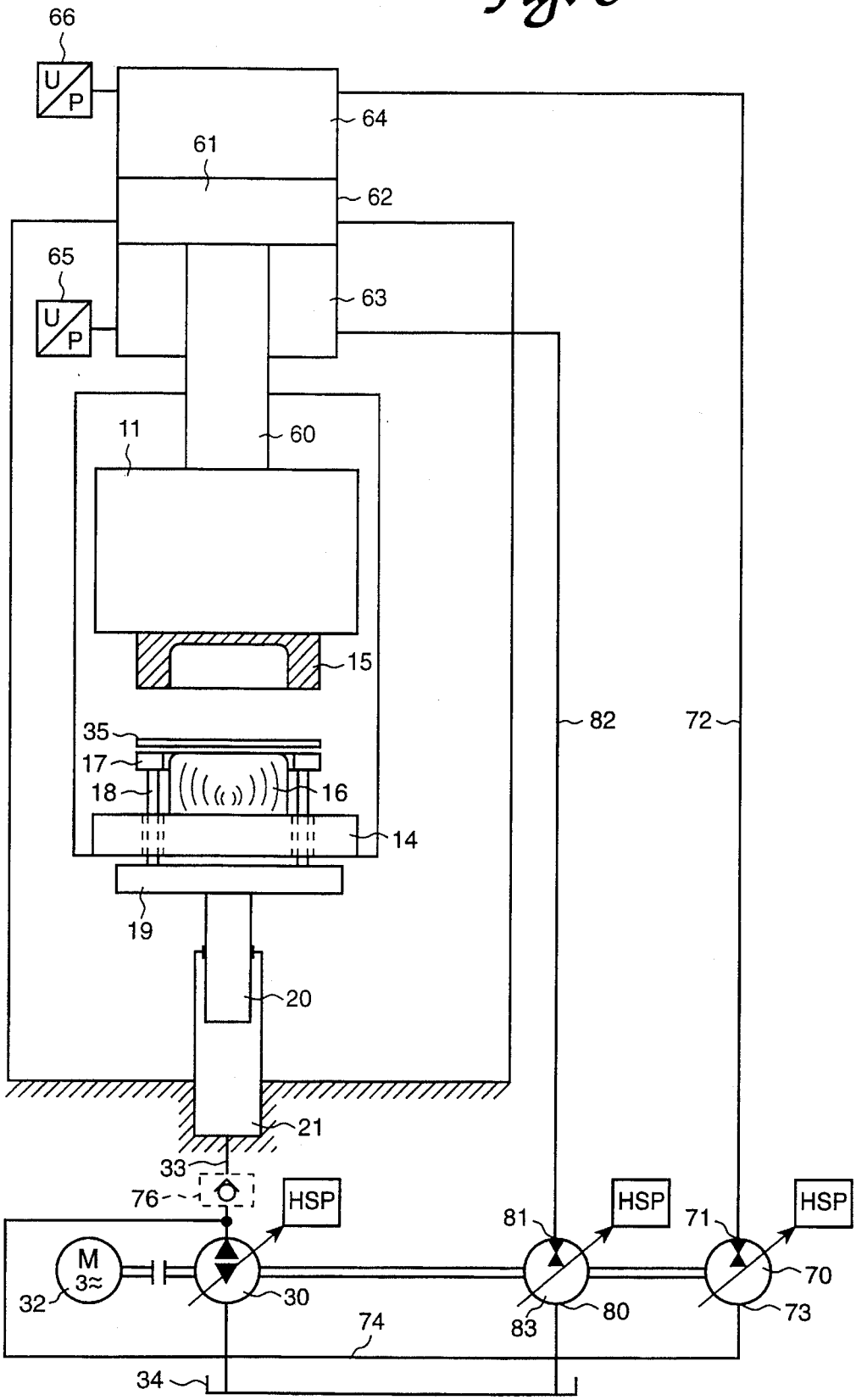
FIG. 6 shows schematically a sixth embodiment which is similar to FIG. 5 wherein, however, a port of the third hydrostatic machine is connected to a port of the first hydrostatic machine located on the side of the hydraulic cylinder.
Figure 7:
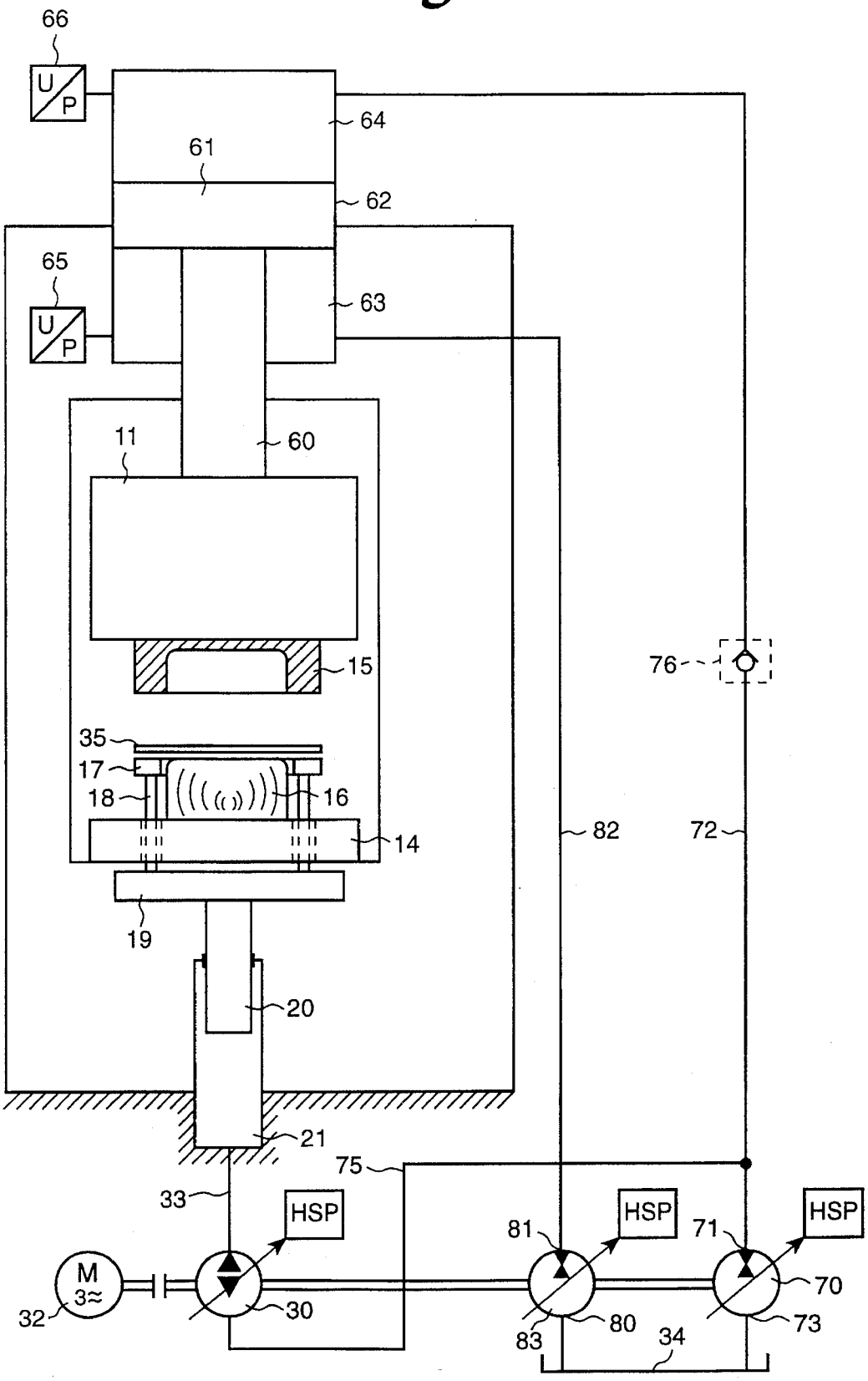
FIG. 7 shows schematically a seventh embodiment which also is similar to the embodiment of FIG. 5, wherein, however, a port of the third hydrostatic machine is connected to the port of the first hydrostatic machine which is located on the side opposite to the hydraulic cylinder.
Figure 8:
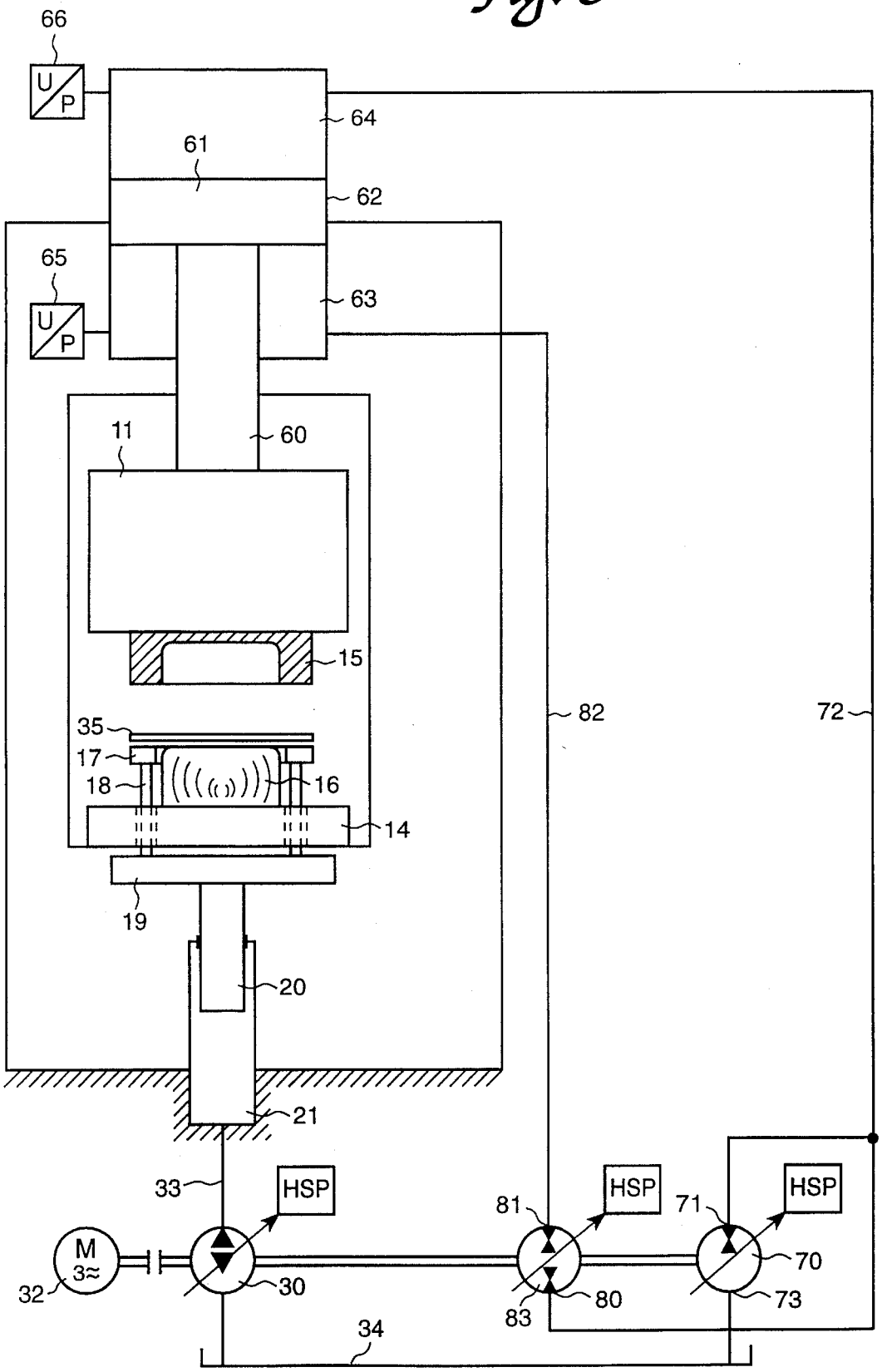
FIG. 8 is a schematic representation of an eighth embodiment which is similar to the embodiment of FIG. 5, wherein, however, the second output of the fifth hydrostatic machine is connected to the press cylinder chamber of the hydraulic cylinder moving the press ram.

The one port of the hydrostatic machine 30 is connected for the embodiments of FIGS. 5 through 8 via a conduit 33 with a hydraulic cylinder 21. The other port is connected as far as the embodiments of FIGS. 5, 6 and 8 are concerned with the tank 34, and as far as the embodiment of FIG. 7 is concerned, by means of a conduit 75 with the conduit 72.

For the embodiment of FIG. 5 the axial piston pump 80 delivers for the return stroke of the piston 61 a certain volume of oil per unit of time into the return stroke cylinder chamber 63. The axial piston pump 80 is hereby operated with flow dependent control. Oil displaced from the press cylinder chamber 63 flows via the axial piston pump 70 to the tank 34. In the pre-movement of the prestroke, during which the press ram moves downwardly due to its own weight and due to the weight of the female tool die 15, the axial piston machine 80 is again flow dependently controlled and operates as a motor. The supply flow determines the lowering speed of the press ram 11. This control can be maintained during the pre-movement and during the operating stroke. The axial piston pump 70 is pressure controlled during the pre-movement with low pressure, and, during the operating stroke it is pressure controlled with high press pressure. It is, in principle, also possible to operate the axial piston machine 80 pressure controlled during the operating stroke at low pressure and to operate the axial piston pump 70 speed controlled. Then, however, after abutment of the press ram, the axial piston machine has to be switched from speed control to pressure control. During the pre-movement, pump 70 maintains a low pressure in the press cylinder chamber 64. During the return stroke, the pump 70 remains under pressure control, wherein also here only a minimum operating pressure is maintained in the press cylinder chamber 64 so as to avoid cavitation. The axial piston machine 70 is switched to flow control during the return stroke so as to achieve a defined lifting speed.

Also for the embodiment of FIG. 8 the axial piston machine delivers during the return stroke of the piston 61 a certain volume of oil per unit of time into the return stroke cylinder chamber 61. The oil is taken from the press cylinder chamber 64 via the line or conduit 72. Oil which is displaced from the press cylinder chamber 64, but is not supplied to the return stroke cylinder chamber 63, which is smaller than the press cylinder chamber 64, drains via the axial piston pump 70 into tank 34.

During the pre-movement of the prestroke of the press ram, a pressure builds up in the return stroke cylinder chamber 63 due to the weight of the press ram 11; due to said pressure built up, oil from the return stroke cylinder chamber 63 is displaced via the conduits 82, the axial piston machine 80 and the conduit 72 into the press cylinder chamber 64. The lowering speed of the press ram 11 is determined by the adjusted swivel or pivot angle of the axial piston machine 80, which is operated during the pre-movement as a motor. A volume of oil which corresponds to the volume of the piston rod 80 moved out of the cylinder 62 is supplied by the pump 70 into the press cylinder chamber 64. So as to reach the complete filling of the press cylinder chamber 64 pump 70 is switched to pressure control and supplies exactly so much that a low pressure is maintained in the press cylinder chamber 64.

The pump 70 of the embodiment of FIG. 8 can be smaller than the pump 70 of FIG. 5 in as much as it does not need to supply the entire necessary amount of oil required for filling the press cylinder chamber 64. If the geometric volumina of stroke of the axial piston machine 80 and of the axial piston machine 70 of the embodiment of FIG. 8 are selected such that the ratio of the stroke volume of the axial piston machine 80 to the stroke volume of the axial piston machine 70 corresponds to the ratio of the annular surface of the return stroke cylinder chamber 63 to the area of the cross section of the piston rod 60, then the pivotal or swivel angle of the axial piston machine 80 and of the axial piston machine 70 can be adjusted synchronously.

In case the weight of the press ram 11 is not sufficient to deform the sheet metal 35 (this can be recognized by a lowering of the load pressure at the pressure gauge 65), the axial piston machine 80 will be switched when a minimum pressure is reached from the flow control to the pressure control, so that the axial piston machine 80 maintains in the return stroke cylinder chamber 63 a minimum pressure which excludes the cavitation in the axial piston machine 80. At the same time, the pump 70 is switched from pressure control to flow dependent control, so that the lifting movement is continued with a defined speed. So as to achieve, after finishing the operating phase, a defined pressing force for a certain holding time or a certain time of flow of material, also the pump 70 is switched to pressure control. Said pump also operates as a supply pump for the axial piston machine 80, so that an additional supply is not necessary for the embodiment of FIG. 8.

During the return stroke the axial piston machine 80 is again switched to flow control and in the return stroke cylinder chamber 63 the load pressure required for lifting the press ram comes into existence. The oil displaced from the press cylinder chamber 64 is supplied to the two apparatuses 80 and 70, wherein the pump 80 maintains a minimum pressure and thus provides always for suction conditions at the output 83 of the axial piston machine 80 now operating as a pump. The excessive volume of oil which corresponds to the piston rod volume is supplied to the tank 36 via the pump 70.

In the embodiments of FIGS. 5 and 8 the hydrostatic machine 30 is, simultaneously, the first as well as the second hydrostatic machine.

For the two embodiments of FIGS. 6 and 7 we will start from the following sequence of functions of the press. In a step a) the piston 20 rests in its lowermost position and the piston 61 moves upwardly. In a step b) piston 20 and piston 61 move upwardly. In a step c) the piston 20 rests in its uppermost position, while the piston 61 moves again downwardly. Eventually, in a last step d) piston 20 and piston 61 both move downwardly, with a counter support pressure existing in hydraulic cylinder 21.

In the embodiment of FIG. 6 machine 80 supplies in step a) oil into the return stroke cylinder chamber 63. Oil flows from the press cylinder chamber 64 via the conduit 72, the machine 70, the line or conduit 74 and the machine 30 to tank 34. In step b) the machine 80 continues to supply the return stroke cylinder chamber 63. Oil flows from the press stroke cylinder chamber 64 via machines 70 and 30 into the tank 34. The machine 30 is volume flow dependent controlled, such that less oil flows via the machine 30 to tank than is displaced from the chamber 64. The access of displaced oil flows to the cylinder 21, so that the piston 20 moves with a desired speed. In step c) is the machine 30 pressure controlled, wherein the controlled pressure corresponds to the counter support pressure. That pressure exists in the hydraulic cylinder 21 and in the conduit 74. The machine 30 also supplies oil to machine 70 which allows, when operating as a motor, that oil can flow in a metered manner into the press cylinder chamber 64 and maintains thereby a pressure controlled low pressure in the chamber 64. Eventually, in step d) the machine 30 is continued to be operated as a pressure controlled pump, inasmuch as the oil volume displaced by the hydraulic cylinder 20 is smaller than the oil volume which has to be supplied into the chamber 64 of the cylinder 62. Depending on the pressure differential between the pressure in the hydraulic cylinder 21 and the pressure in the chamber 64, the machine 70 is operated as a motor (pressure in hydraulic cylinder 21 is higher than the pressure in chamber 64), or as a pump (pressure in the hydraulic cylinder 21 is lower than the pressure in chamber 64), and is thereby pressure controlled.

In the embodiment of FIG. 6 oil flows in step d) from the hydraulic cylinder 21 via the machine 70 to the chamber 64. Thus, in the embodiment of FIG. 6, the machine 70 is the third hydrostatic machine and at the same time the second hydrostatic machine.

So as to be in a position to move—for a resting counter support 17—(only) the ram 11 of the embodiment of FIG. 6 by itself, it is possible that during such a movement the machine 30 supplies into the line 74 occurs with such a low pressure that said pressure is not sufficient to cause the piston 20 move outwardly. If it is desired to operate the machine 30 with a higher pressure and to increase the safety, then a check valve 76 can be located in the conduit 33 between the connecting point of line 74 to line 33 and the hydraulic cylinder 21, said check valve 76 being a pilot controlled check valve which can be blocked and opened towards the hydraulic cylinder 21. For the sole movement of piston 20, the machines 70 and 80 are adjusted to a swivel or pivot angle of zero.

In the embodiment of FIG. 7 the machine 80 supplies in step a) oil to the chamber 63. Oil from the chamber 64 flows via the machine 70 to tank 34. The machine 30 is adjusted to a swivel or pivot angle of zero.

In step b) the machine 80 continues to supply oil to the chamber 63. The machine 30 supplies pressure medium in a flow controlled manner from conduit 75 into the hydraulic cylinder 21. Excess oil from the chamber 64 flows via the machine 70 to tank.

In step c) the machines 30 and 70 are switched to pressure control, wherein the machine 30 maintains in the hydraulic cylinder 21 the counter pressure and the machine 70 maintains in the press stroke cylinder chamber 64 a low pressure. The machine 80 allows, operating as a motor, the drainage of oil in a metered manner from chamber 63 to tank 34.

Eventually in step d) the machine 80 continues to meter. Machines 30 and 70 are operated under pressure control, wherein the machine 30 maintains the counter support pressure in the hydraulic cylinder 21 and the machine 70 maintains the press pressure in the press stroke cylinder chamber 64. In case the counter support pressure is larger than the press pressure, then the machine 30 will be operated in step d) as a motor. If, however, the counter support pressure is smaller than the press pressure, then the machine 30 operates as a pump. In any case, oil displaced from the hydraulic cylinder 21 is drained via the machine 30. For that reason, the hydrostatic machine 30 is considered for the embodiment of FIG. 7 as well as for the embodiments of FIGS. 5 and 8 to be at the same time the first and the second hydrostatic machine.

So as to move the piston 20 by itself, with the ram 11 being at rest, the volume supplied by the machine 70 can be adjusted with respect to the volume supplied by the machine 30 such that no substantial pressure is built up in conduits 72 and 75. For reasons of safety it is, however, also here favourable to provide a piloted check valve 76, i.e. a check valve which can be released, said check valve being located in the conduit 72 and blocks towards the press stroke cylinder chamber 64.

An essential difference between the two embodiments of FIGS. 6 and 7 is also the following: for the embodiment of FIG. 6 the supply volume of the machine 30 has to be at least as large as the supply volume of the machine 70 so that for a large cylinder 62 two relatively large hydrostatic machines are required. For the embodiment of FIG. 7, the machine 30 can normally be substantially smaller than the machine 70, inasmuch as the piston 20 is substantially smaller than the piston 62.

Similar to the embodiment of FIG. 5, for the embodiment of FIG. 9 again a variable displacement pump 70 is connected with a suction port 73 to the tank 34 and with the pressure port 71 via a conduit 72 to the press cylinder chamber 64, independently of the axial piston machine 80.

Figure 9:
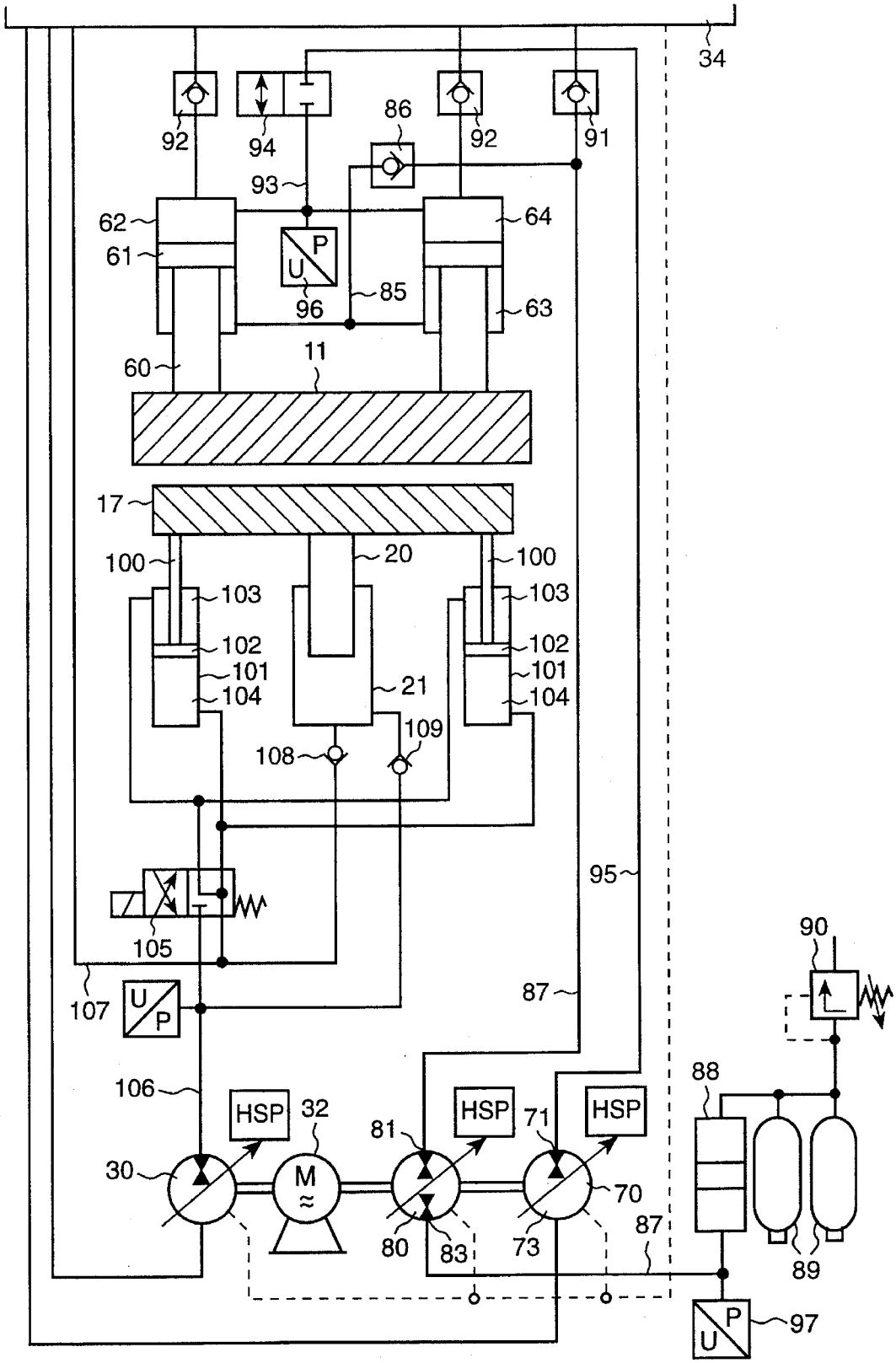
FIG. 9 is a schematic representation of a ninth embodiment, wherein the second output of the fifth hydrostatic machine is connected to a hydraulic accumulator.

The press shown schematically in FIG. 9 comprises a press ram 11 which is mounted at two piston rods 60 of the two vertically arranged differential cylinders 62. The piston 61 of a differential cylinder 62 divides the interior of said cylinder into an annular return stroke cylinder chamber 63 on the piston rod side, and into a press cylinder chamber 64 on the piston side. The press ram 11 can be moved vertically up and down with the piston 61 and the piston rod 60.

A counter support 17 is fixedly mounted to a plunger 20 of a plunger cylinder 21 and is located on the piston rods 100 of a plurality of differential cylinders 101; the interior of each of said cylinders 101 is divided by a piston 102 into a piston rod side chamber 103 and a piston side chamber 104. The two chambers 104 are commonly connected to an output and the chambers 103 are commonly connected to another output of a 4/2 directional control valve 105 which can be actuated by a solenoid. The first input of the two inputs of the directional control valve 105 is connected via a conduit 106 to the pressure port of the axial piston machine 30 and the second input is connected via a conduit 107 to the tank 34. In the rest position of the directional control valve 105 its first input is blocked while the two outputs are connected with the second input. In the switching position of the directional control valve 105 there exists a connection between the first input and the chambers 104 and between the second input of the directional control valve 105 and the chambers 103 of the differential cylinder 101. The plunger cylinder 21 is connected via a check valve 108, which opens towards the plunger cylinder 21, to the conduit 107 and thus to the tank; the plunger cylinder 21 is further connected via a check valve 109, which blocks towards the plunger cylinder 21, to a conduit 106 and thus to the pressure port of the axial piston machine 30.

In the rest position of the directional control valve 105 of FIG. 9 the electric motor 32 and the axial piston machine 30 may run, without the possibility that the counter support 17 moves upwardly. In the switching position of the directional control valve 105 the axial piston machine 30 supplies oil to the chambers 104 of the differential cylinder 101, so that the counter support 18 is lifted upwardly. During said upward movement piston 20 drags along the plunger cylinder 21. Via the check valve 108 oil from the tank 34 will flow into said plunger cylinder 21. During operation, the press ram 11 urges or presses the counter support 17 downwardly wherein the axial piston machine 30 maintains in the plunger cylinder 21 and in the chambers 104 of the differential cylinders 101 a certain pressure and the oil displaced both from the chambers 104 as well as from the plunger cylinder 21 is drained across the axial piston machine 30 into the tank 34. In this context the axial piston machine 30 is operated as a motor and supplies power to the electric motor 32 and, respectively, to the axial piston machines 80 and 70.

The return stroke cylinder chamber 63 of the two differential cylinders 62, which move the press ram 11, are connected via a conduit 85 with a releasable check valve 86 which opens towards the return stroke cylinder chambers. On the other hand, the check valve 86 is connected via a conduit 87 to a first output 81 of a first axial piston machine 80 which can be swivelled across or pivoted beyond zero; the second output 83 of said axial piston machine 80 is connected via a conduit 87 with a hydraulic accumulator 88 which is designed as a piston accumulator. Two gas containers 89 are arranged together with a hydraulic accumulator to increase the gas volume; together with said gas containers a gas safety valve 90 is provided. Between the conduit 87 and the tank 34, which is located above the cylinder 62, a releasable, i.e. pilot controlled check valve 91 is placed which blocks towards the tank 34.

The press cylinder chambers 64 of the two cylinders 62 are each connected via a hydraulically releasable (pilot controlled) check valve 92 of large dimensions with the tank 34. The two check valves 92 block towards the tank 34. On the other hand, the two press cylinder chambers 64 are connected via a conduit 93, a 2/2 directional control poppet valve 94 and a conduit 95 to the pressure ports 71 of a second axial piston machine 70 which is swivellably beyond or pivotable accross zero; said axial piston machine 70 is connected with its suction port 73 to the tank 34. The two axial piston machines 70 and 80 as well as the axial piston machine 30 are commonly driven by a 3-phase motor as is true for the embodiments of FIGS. 5 and 6. The supply flow of the two axial piston machines 70 and 80 can be continuously adjusted by means of a servo valve with the swivel or pivot angle being electrically reported. In addition, a pressure and power control is possible. The adjustment and control possibilities are indicated by the three letters HSP.

So as to determine or measure the pressure in the press cylinder chambers 64, a pressure sensor 96 is connected to the conduit 93. The pressure in the hydraulic accumulator 88 is measured by a pressure sensor 97 connected to the conduit 87.

From the lifted position shown in FIG. 9, the press ram 11 can move downwardly based on its own weight provided the check valve 86 is opened. Then the piston 61 displaces oil from the return stroke cylinder chambers 63 via the axial piston machine 80 into the hydraulic accumulator 88. Oil from the tank flows via the check valves 92 into the press cylinder chambers 64. The volume flow which flows accross the axial piston machine 80 can be determined by an electro proportional adjustment of the swivel or pivot angle of the machine. Thus, the speed of lowering the press ram 11 is determined. As a consequence, the potential energy of the press ram 11 is transformed into pressure energy during the pre-movement during which the press ram 11 is moved based on its own weight, said pressure energy is stored in the hydraulic accumulator 88. The speed of the axial piston machine 90 is determined by the electric motor 32.

For the press operation, after abutment of the press ram 11 on the counter support 17, the pilot controlled, releasable check valve 91 opens so as to switch the annular surface of the piston 61 "pressureless". For the press operation, which follows the abutment of the press ram 11 on the counter support 17, the presence of a certain pressure is controlled in the press cylinder chamber 64 by the axial piston machine 70, which supplies oil into the press cylinder chamber 64 with the valve 91 being open. During the press operation the axial piston machine 80 charges during pump operation the hydraulic accumulator 88 with a small volume flow and thus with a small power consumption up to the desired state of charge. After the press operation the valve 94 closes again.

The return stroke of the press ram 11 occurs under control or closed loop control of the speed with which the axial piston machine 80 supplies oil stored in the hydraulic accumulator 88 into the return stroke cylinder chambers 63, with the check valve 91 being closed. Here, the electric motor 32 need only supply the torque for the pressure increase of the volume flow from the pressure of the accumulator up to the acceleration- and load pressure required for the lift movement. During the return stroke oil is displaced from the press cylinder chamber 64 via the released check valves 92 to the tank 34. By using the energy stored in the hydraulic accumulator 88 for the return stroke of the press ram 11 the drive power of the electric motor 32 can be reduced to the power required for the pressing operation. During the pressing operation the energy of lowering the counter support 17 is used by the axial piston machine 30 for driving the axial piston machines 80 and 70 so that the required drive power is even more reduced by the regained power of lowering. Thus, the electric motor requires for the press operation only the differential of power between the press power for the press ram and the press power for the counter support 17. Thus, the loss of power is significantly reduced. Also, an electric motor having a lower rated power can be used.

It is the purpose of the valve 86 to maintain the press ram 11 in a lifted position. In case said valve is closed, then between said valve 86 and the piston 61 of the cylinder 62 an amount of oil is enclosed which prevents a lowering of the press ram 11. Then, tools can be exchanged or repairs can be made.

Figure 10:
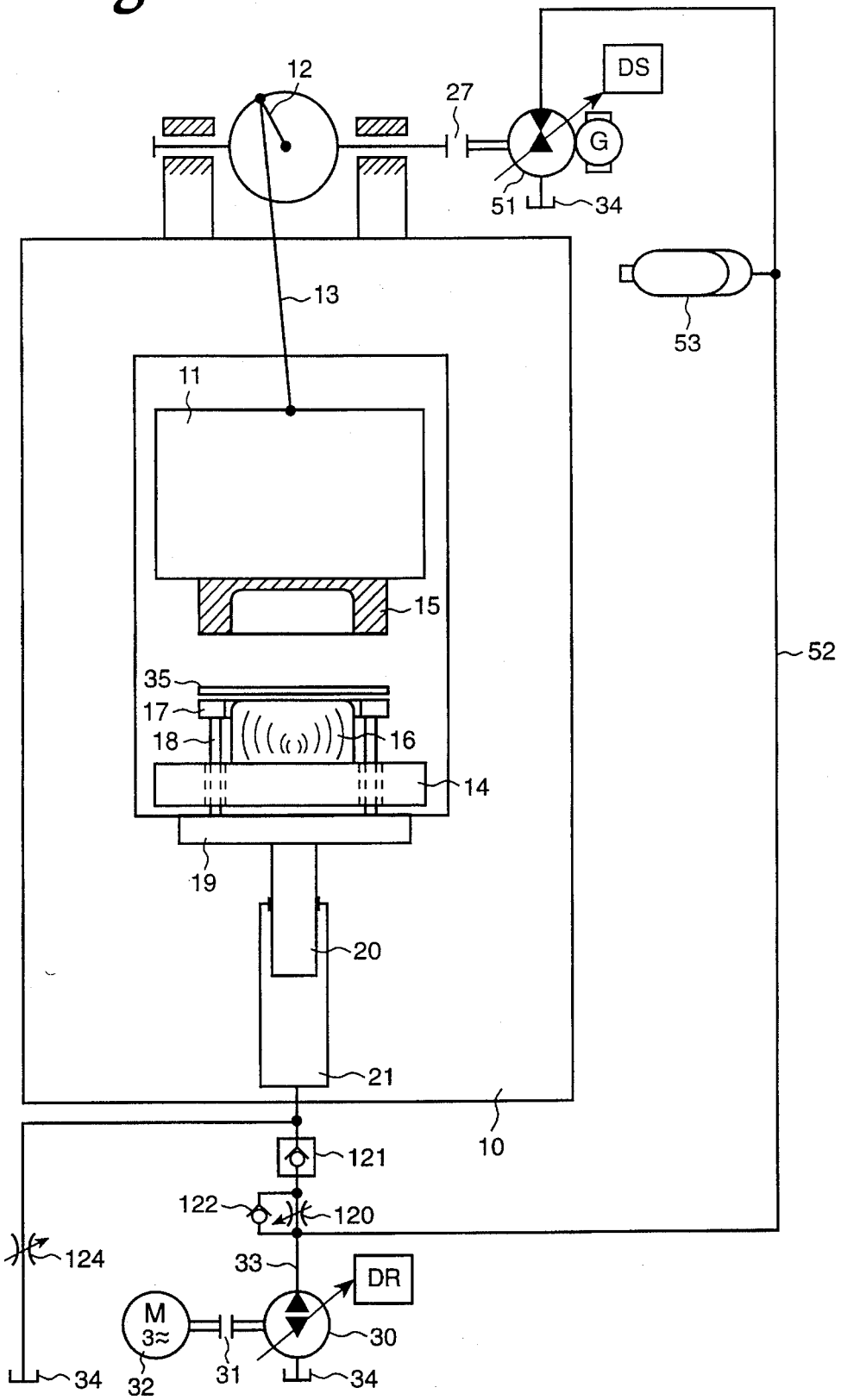
FIG. 10 shows schematically a tenth embodiment having a strong similarity to the embodiment of FIG. 4, wherein, however, the primary unit of the secondary controlled drive system for the press ram is hydraulically also connected with the hydraulic cylinder of the counter support.

Also, for the embodiment of FIG. 10, a hydrostatic machine is mechanically coupled to a 3-phase motor 32 by means of a fixed coupling 31, said hydrostatic machine being designed as an axial piston machine having a pressure control only and being of the type providing swiveling in both directions. The term pressure control means here that the swivel or pivotal angle of the machine is adjusted such that the machine when operating as a pump supplies such a volume of pressure medium that at the pressure side a predetermined pressure is adjusted or achieved. In the present case, this pressure should correspond to the pressure which has to exist in the hydraulic cylinder 21 so that the sheet metal 35 is fixedly clamped between the counter support 17 and the female tool die 15. In a comparison with the embodiment of FIG. 4 one recognizes that the hydrostatic machine corresponds with respect to its control to the hydrostatic machine 50 of FIG. 4. On the other hand, however, the hydrostatic machine of FIG. 10 driven by the motor 32 is used to lift the counter support 17. Therefore, the hydrostatic machine in FIG. 10 is referred to by reference numeral 30 and has to be considered as the first hydrostatic machine. Said hydrostatic machine 30 of FIG. 10 is connected on its pressure side via a conduit 33 with the cylinder 21 and on the other side to the tank 34. However, in conduit 33 there is a series arrangement of an adjustable flow valve 120 and a pilot controlled (releasable) check valve 121 which blocks towards the hydraulic cylinder 21. In the bypass of the flow valve 120 a check valve 122 is provided which also blocks towards the hydraulic cylinder 21.

The hydrostatic machine 51 is coupled to a tacho generator 123 as is true for the embodiment of FIG. 4, said tacho generator 123 tapping or sensing the speed of the machine 51. Further, a first port of the hydrostatic machine 51 is connected to tank 34 and a second port is connected directly via a line or conduit 52 to the pressure side of the machine 30, thus bypassing valves 120, 121 and 122. A hydraulic accumulator 53 is also connected with the conduit 52. The hydrostatic machines 30 and 51 as well as the accumulator 53 belong to a secondarily controlled circuit within which the speed of the machine 51 is controlled. By changing the swivel or pivot angle the machine seeks automatically the respective required torque so as to maintain the predetermined speed for the respective present operating pressure in line or conduit 52. For instance, if the machine is too slow, then the pivot angle is increased and thus the torque is somewhat increased until the desired speed is reached.

The hydraulic machine 30 is shown as swiveling in both directions, i.e. being pivotable towards both sides. However, the drive should be designed such that no drainage of pressure medium occurs to the tank via machine 30. During such a drain the machine 30 would be operated as a motor and drives the motor 32 so that energy would be fed into the electric power supply system. Inasmuch as the change from mechanical energy into electrical energy entails large losses, such a situation should be avoided by the proper design of the drive. The machine 30 can then be designed as a machine swiveling in one direction, i.e. pivoting towards one side.

In the condition of the press shown in FIG. 10 the valve 121 is released (i.e. not blocked) and in the hydraulic cylinder 21 and in the conduit 52 exists a pressure which corresponds to the pressure adjusted at the machine 30, a pressure which corresponds to the counter support pressure. The ram 11 moves downward and, eventually, carries along the counter support 17 and thus the piston 20. Pressure medium is displaced from the cylinder 21 via the check valve 122 and the conduit 52 to the machine 51 and flows via said machine 51 to the tank 34. The machine 51 is also the second hydrostatic machine. The machine 30 will supply only additional volume of pressure medium required by the machine 51. The valve 121 can now be closed for a short time so as to lift the ram 11 alone. For lifting the counter support 17 the valve will again be blocked so that pressure medium flows from the pressure side of the machine into the hydraulic cylinder 21, wherein the controlled pressure existing in conduit 52 and corresponding to the counter support pressure is reduced via the flow valve 120 to the required load pressure which is necessary for lifting the counter support 17 including the bolts 18, the support plate 19 and the piston 20.

For the operation during installment and during a trial run it may be desirable that the counter support 17 is lowered without a movement of the press ram 11. For such a situation an adjustable throttle valve 124 is provided which is connected to the pressure chamber of the cylinder 21 and by means of which pressure medium can be drained to the tank 34. In normal operation the throttle valve 124 is closed. Only for the operation during installment or for a trial run of the press ram with lowered counter support the valve 121 remains closed.

We claim:

1. A hydraulic drive for a press, said press comprising a press ram (11) which can be moved mechanically up and down, and a hydraulically movable counter support (17), said counter support being movable in a forward stroke in a direction towards the press ram (11) via at least one hydraulic cylinder (21, 101) by means of a first hydrostatic machine (30), and in a return stroke by said press ram (11), wherein said first hydrostatic machine (30) is designed as a pressure controlled axial piston machine of variable over center displacement and that the press ram (11) is mechanically coupled to a second hydrostatic machine (41, 51) which is speed controlled, said second hydrostatic machine being driven at least during a part of the return stroke of the counter support (17) as a hydraulic motor, indirectly by means of pressure medium displaced from said hydraulic cylinder (21).

2. The hydraulic drive of claim 1, wherein the first hydrostatic machine (30) is provided with a flow control and a pressure control overriding the flow control.

3. The hydraulic drive of one of claims 1 or 2, wherein the pressure medium displaced from said hydraulic cylinder (21) is displaceable via the first hydrostatic machine (30) which is operable as a hydraulic motor, the first hydrostatic machine (30) is mechanically coupled to a third hydrostatic machine (40, 50) having variable displacement, and the third hydrostatic machine (40, 50) is hydraulically coupled to the second hydrostatic machine (41, 51).

4. The hydraulic drive of claim 3, wherein the second hydrostatic machine (41) is a motor of fixed displacement and the third hydrostatic machine is a hydraulic pump of variable displacement, and the second hydrostatic machine (41) and the third hydrostatic machine (40) are arranged in a closed hydraulic circuit.

5. The hydraulic drive of claim 3, wherein the second hydrostatic machine (41) and the third hydrostatic machine (50) are arranged in an open hydraulic circuit.

6. The hydraulic drive of claim 5, wherein the second hydrostatic machine (51) is a secondary unit of a secondarily controlled drive, said secondarily controlled drive comprising as a hydrostatic primary unit (30, 50) the third hydrostatic machine (50).

7. The hydraulic drive of claim 6, wherein a hydraulic accumulator (53) is connected with a connecting conduit (52) between the secondary unit (51) and the primary unit (50).

8. A hydraulic drive for a press, said press comprising a press ram (11) which can be moved mechanically up and down, and a hydraulically movable counter support (17), said counter support being movable in a forward stroke in a direction towards the press ram (11) via at least one hydraulic cylinder (21, 101) by means of a first hydrostatic machine (30), and in a return stroke by said press ram (11), wherein said first hydrostatic machine (30) is designed as a pressure controlled machine of variable displacement and that the press ram (11) is mechanically coupled to a second hydrostatic machine (41, 51) which is speed controlled, said second hydrostatic machine being driven at least during a part of the return stroke of the counter support (17) as a hydraulic motor, directly by means of pressure medium displaced from said hydraulic cylinder (21).

9. The hydraulic drive of claim 8, wherein a first port of the second hydrostatic machine (51) is connected to a tank (34) and a second port of said second hydrostatic machine, the hydraulic cylinder (21) of the counter support (17) and a pressure port of the first hydrostatic machine (30) are hydraulically connected with each other, said first hydrostatic machine (30) being pressure controlled and driven by a motor (32).

10. The hydraulic drive of claim 9, wherein between the second port of the second hydrostatic machine (51) and the pressure port of the first hydrostatic machine (50) and the hydraulic cylinder (21), a flow control valve (120) is arranged, said flow control valve being effective for a direction of movement of the hydraulic cylinder (21) corresponding to the forward stroke of said counter support but ineffective for a direction of movement of the hydraulic cylinder (27) corresponding to the return stroke of said counter support.

11. The hydraulic drive of claim 10, wherein a check valve (122) which allows free flow of pressure medium from the hydraulic cylinder (21) is provided in a bypass to said flow control valve (120).

12. The hydraulic drive of one of the claims 9–11 wherein, between the second port of the second hydrostatic machine (51) and the pressure port of the first hydrostatic machine, (30) and the hydraulic cylinder (21), a valve (121) is arranged by means of which flow of pressure medium to the hydraulic cylinder (21) can be blocked, said valve being a pilot controlled check valve (121) which closes towards the hydraulic cylinder (21) but is releasable.

13. The hydraulic drive of claim 12, wherein between the hydraulic cylinder (21) and the tank (34) a valve (124) is provided, by means of which pressure medium from the hydraulic cylinder (21) can be drained to the tank (34), bypassing the first hydrostatic machine (30) and the second hydrostatic machine (51).

14. The hydraulic drive of claim 9, wherein the second hydrostatic machine (51) is a secondary unit of a secondarily controlled drive, said secondarily controlled drive comprising as a hydrostatic primary unit (30, 50) the first hydrostatic machine (30).

15. The hydraulic drive of claim 14, wherein a hydraulic accumulator (53) is connected with a connecting conduit (52) between the secondary unit (51) and the primary unit (30, 50).

* * * * *